United States Patent [19]

Cayley et al.

[11] Patent Number: 4,578,907

[45] Date of Patent: Apr. 1, 1986

[54] GUARD FOR GRINDER WHEEL

[75] Inventors: Michael P. Cayley, South Barrington; Malcolm E. Keith, Wheaton, both of Ill.

[73] Assignee: Midaco Corporation, Elk Grove Village, Ill.

[21] Appl. No.: 607,581

[22] Filed: May 7, 1984

[51] Int. Cl.[4] ..... B24B 55/04

[52] U.S. Cl. ..... 51/268; 51/166 R

[58] Field of Search ..... 51/272, 268, 166 R, 51/166 TS, 166 MH, 166 FB

[56] References Cited

U.S. PATENT DOCUMENTS

| | | | |
|---|---|---|---|
| 596,762 | 1/1898 | Sevison | 51/272 |
| 1,047,571 | 12/1912 | Sadler | 51/272 |
| 1,580,903 | 4/1926 | Kelleher | 51/272 |
| 1,633,412 | 6/1927 | Kelleher | 51/272 |
| 2,069,395 | 2/1937 | Tautz | 51/272 |
| 2,621,452 | 12/1952 | Wells | 51/166 TS |
| 2,867,064 | 1/1959 | Hermansson | 51/272 |

*Primary Examiner*—Roscoe V. Parker

*Attorney, Agent, or Firm*—Hill, Van Santen, Steadman & Simpson

[57] ABSTRACT

A guard for a grinder wheel wherein the guard has a base structure upon which the grinder is mounted to affix it to a support and the base has four upright members and cross-structures which support bullet proof clear plastic through which the grinding operations can be observed by the operator. A lighting fixture is mounted through the transparent plastic such that the transparent plastic cannot be removed from the guard without completely disassembling the lighting fixture which prevents the operator from removing the guard from the machine. The lighting switch for the lighting fixture is interconnected with the switch for driving the grinder motor so that the operator will know when the light is turned off that the grinder motor has been turned off.

6 Claims, 4 Drawing Figures

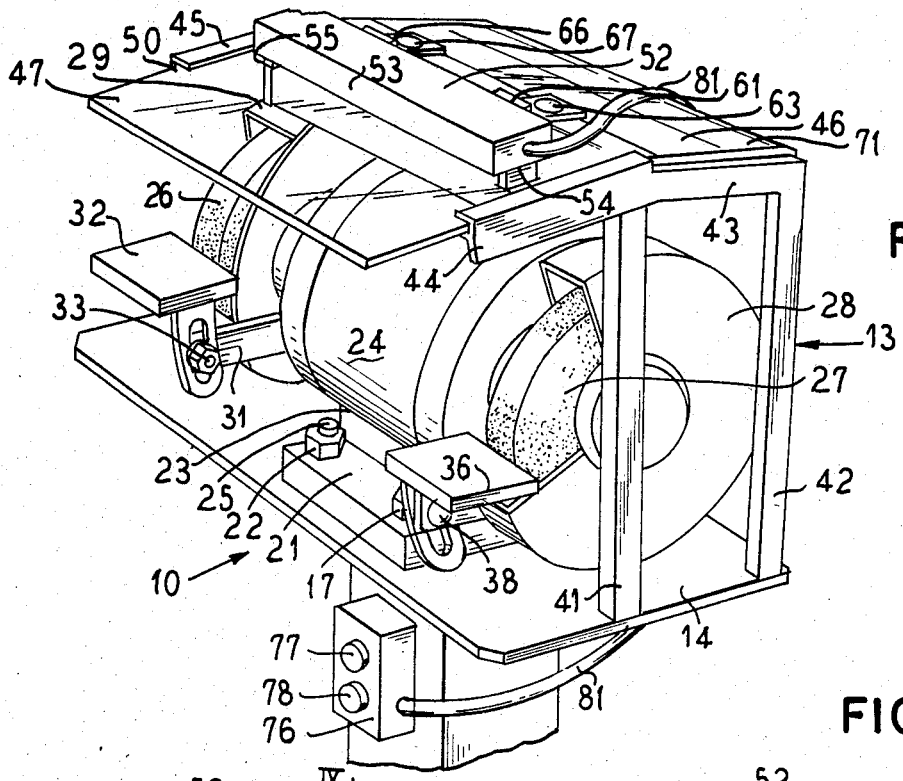
FIG. 1
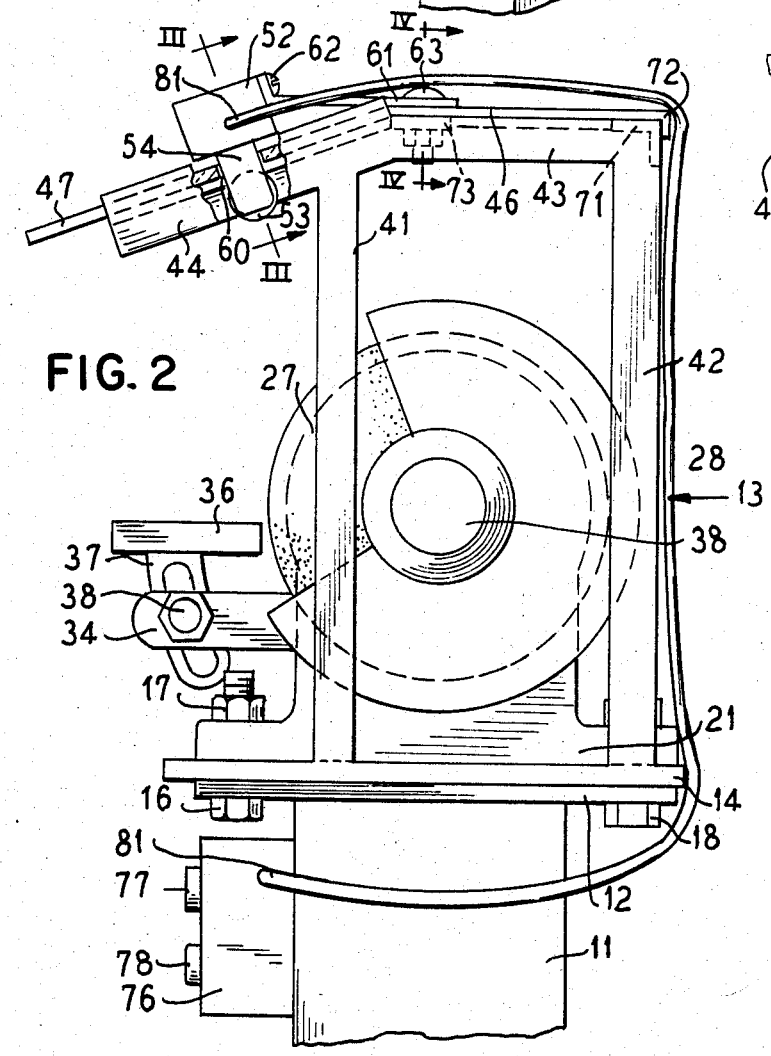
FIG. 2
FIG. 3
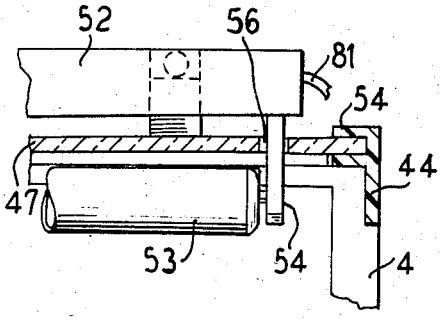
FIG. 4
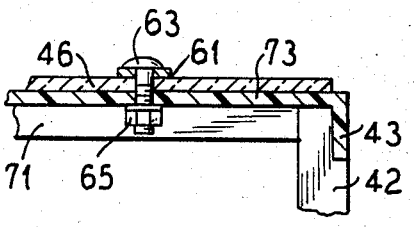

GUARD FOR GRINDER WHEEL

BACKGROUND OF THE INVENTION

1. Field of the Invention

This invention relates in general to guards for grinders and other tools and in particular for a grinder guard which cannot be removed by the operator.

2. Description of the Prior Art

Guards for grinders and other machines generally comprise a small transparent member which can optionally be moved in position to protect the operator. Since the conventional small guards make it difficult for the operator to see the work, the operator often does not use the guards and moves them away from the machine so that they do not protect him or in many cases completely disassemble the guard so it is no longer attached to the machine.

SUMMARY OF THE INVENTION

The present invention comprises a protective guard for a grinder or other machine which comprises clear bullet proof plastic which is mounted in a frame that has a base through which the mounting brackets for the machine extend so that when the machine is mounted, the guard structure is rigidly and integrally formed with the machine and the machine support. The guard has clear bullet proof plastic guard members which are mounted in suitable channel portions of the guard so that they cannot be easily removed. A lighting fixture is attached to the guard and is arranged such that the protective plastic plates of the guard cannot be removed without disassembling the lighting fixture. The lighting fixture is connected to the power switches for the drive motor of the grinder such that when the grinder motor is energized the light will be on and when the motor is unenergized the light will be off so that the operator can tell by observing the light whether the drive motor is on or off.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 1 is a perspective view of the grinder and guard of the invention;

FIG. 2 is an end plan view of the invention;

FIG. 3 is a partially cut-away sectional view of the invention taken on lines III—III from FIG. 2; and FIG. 4 is an enlarged sectional view taken on line IV—IV from FIG. 2.

DESCRIPTION OF THE PREFERRED EMBODIMENTS

FIGS. 1 and 2 illustrate the novel guard of the invention for a grinder 10 which has a motor 24 with an output shaft 38 upon which a pair of grinder wheels 26 and 27 are mounted. Guards 28 and 29 partially extend around the grinder wheels 27 and 26. The motor 24 is attached to a frame member 21 that has a lower flange portion through which bolts 16, 18, 25 extend. The bolts extend through a flange 12 on a support member 11 and pass through a flat base portion 14 of the novel guard 13 of the invention. Nuts such as 17 and 22 are threadedly received on the bolts 16, 18 and 25 to lock the base plate 14 of the guard 13 to the base plate 12 of the support 11 and the support 21 of the motor 24.

The grinder has a couple of outwardly extending support members 31 and 34 which carry rests 32 and 36 that are connected by bolts 33 and 38 to the rests 31 and 34. The rests 32 and 36 are used by the operator as he grinds various workpieces.

The guard 13 has four upwardly extending frames with two members 41, 42 at a first end adjacent the grinder wheel 27 and a pair of similar upright members at the other end of the guard adjacent the grinding wheel 26. Horizontal cross-member 43 join the tops of members 41 and 42 as shown in FIG. 2 and a lower frame portion 44 extends downwardly from the member 43. Equivalent cross-member extends between the upright members adjacent the grinding wheel 26 and a downwardly extending portion 45 is illustrated in FIG. 1.

The portions 44 and 45 are formed with channels such as channel 54 illustrated in FIG. 3 and a first sheet of transparent plastic material 47 is mounted in the channels 54 between the members 44 and 45. A second plastic sheet 46 is mounted between the member 45 and the other cross-frame member and has a downwardly extending edge 72 that fits over a transverse frame member 71 extending between the member 43 and the other end member. A transverse member 73 illustrated in FIG. 2 and FIG. 4 is formed with openings through which bolts 63 and 67 extend to support bracket members 61 and 66 which are connected by screws 62 to a lighting fixture which has a housing 52 and a fluorescent bulb 53. The fluorescent bulb 53 is supported by the housing 54 by end members 54 and 55 which extend through openings 60 formed in the plastic sheet 47.

A power cord 81 extends from the member 52 down to a power box 76 mounted on the support 11 and which has on and off switches 77 and 78 so as to energize the motor 24 as well as the light 53.

As shown in FIG. 4, the bolts 63 and 65 lock the plastic sheet 46 to the frame member 73 as well as the support member 61 for the light housing 52.

In operation, the operator presses the on switch 77 to energize the motor 24 which drives the grinding wheels 26 and 27. Simultaneously, power is applied to the supply cord 81 to the light 53 so that it is turned on. The operator then uses the grinder looking through the clear plastic 47 and/or 46 which allows the work to be clearly observed during grinding. The plastic sheets 46 and 47 might be General Electric LEXAN which is a bullet proof plastic. Thus, in the event one of the grinder wheels 26 or 27 were to explode the plastic sheets 47 and/or 46 would protect the operator's face and head from flying debris from the wheels.

Due to the novel construction of the guard wherein the base plate 14 fits under the support 21 of the motor 24 the guard 13 cannot be removed without removing the motor 24 from the support plate 12. Generally, an operator will not go to this much trouble to remove a guard from a machine since this requires a complete disassembling of the grinder and motor from its support. Since the plastic plates 46 and 47 are integrally interconnected with the light fixture comprising the housing 52, the downwardly extending arms 54 and 55 and the light bulb 53 as well as the bolts 63 and 67, the operator cannot remove the protective plastic sheets 46 and 47 from the grinder without a major disassembly of the machine. For this reason, it is unlikely that the operator will disassemble and remove the plastic sheets 46 and 47 and, thus, the grinder will be used with the guards in place to greatly increase the safety of the operator.

It is often times difficult to determine whether the motor 24 is energized since you cannot tell by merely looking at the high speed rotating grinder wheels 26 and 27 that they are rotating and the motor is energized and in the present invention the light 53 is connected to the common power source through the cable 81 such that when the motor 24 is energized, the light 53 will be turned on. Thus, the operator will know that whenever the light is on, the machine is rotating and vice versa when the light is off the motor 24 is de-energized. This is a safety factor in that the operator will not accidentally engage the grinders 26 or 27 at a time when they are rotating at high speed and when he thinks that the motor 24 is de-energized. Also, this is a power saving feature in that when the operators or maintenance personnel walk through the plant during periods when the operators are not present, they can tell that a particular machine is energized if its light 53 is on. Thus, in off hours, all of the machines can be turned off and it can be easily determined that the machines are de-energized.

Although the invention has been described with respect to preferred embodiments, it is not to be so limited as changes and modifications may be made therein which are within the full intended scope as defined by the appended claims.

We claim as our invention:

1. A guard for a grinder with a motor or other ool comprising a planar base member, a support member with a planar support, said motor having a motor stand which has a planar portion, fastening means connecting said planar base member, said planar support and said planar portion together, at least two upwardly extending frame members attached to said planar base member, and a first sheet of tough transparent plastic extending between said two upwardly extending frame members, including a first pair of substantially parallel horizontal frame members attached to upper portions of said two upwardly extending frame members and said first sheet of tough transparent plastic connected to said first pair of substantially horizontal frame members, including a lighting fixture with a light attached to said first transparent sheet, wherein said lighting fixture includes a housing and a fluorescent tube which is mounted to said housing, and wherein a pair of fluorescent tube supports extend through said first transparent sheet and said housing mounted on one side of said first transparent sheet and said fluorescent tube attached to said tube supports on a second side of said first transparent sheet.

2. A guard for a grinder or other tool according to claim 1 including a second tough transparent plastic sheet attached to said first pair of substantially horizontal frame members.

3. A guard for a grinder or other tool according to claim 1 including a power supply, and a power switch connected between said motor and power supply and said lighting fixture and said power supply.

4. A guard for a grinder or other tool according to claim 1 wherein said planar base member is mounted between said planar support and said planar portion.

5. A guard for a grinder with a motor or other tool comprising a planar base member, a support member with a planar support, said motor having a motor stand which has a planar portion, fastening means connecting said planar base member, said planar support and said planar portion together, at least two upwardly extending frame members attached to said planar base member, a first sheet of tough transparent plastic extending between said two upwardly extending frame members, including a first pair of substantially parallel horizontal frame members attached to upper portions of said two upwardly extending frame members said first sheet of tough transparent plastic connected to said first pair of substantially horizontal frame members including a lighting fixture with a light attached to said first transparent sheet, a second tough transparent plastic sheet attached to said first pair of substantially horizontal frame members, and a second horizontal frame member extending between said first pair of substantially horizontal frame members and said lighting fixture attached to said second horizontal frame member.

6. A guard for a grinder with a motor or other tool comprising, a planar base member, a planar support, a motor with a motor stand which has a planar portion, fastening means attaching said planar base member, said planar support and said planar portion together with said planar support mounted between said planar base and said planar portion, an upwardly extending frame member attached to said planar base member, a sheet of tough transparent plastic connected to an upper portion of said upwardly extending frame member, and having first and second planar portions which are joined together, said first portion extending outwardly over said motor and grinder with a lighting fixture with a light mounted therein, and said first portion, and said second portion of said plastic sheet extending over said motor to protect a user from said grinder.

* * * * *